US009130252B2

(12) United States Patent
Isom et al.

(10) Patent No.: US 9,130,252 B2
(45) Date of Patent: Sep. 8, 2015

(54) SYMMETRIC BALUNS AND ISOLATION TECHNIQUES

(71) Applicant: Raytheon Company, Waltham, MA (US)

(72) Inventors: Robert S. Isom, Allen, TX (US); Justin A. Kasemodel, McKinney, TX (US)

(73) Assignee: Raytheon Company, Waltham, MA (US)

( * ) Notice: Subject to any disclaimer, the term of this patent is extended or adjusted under 35 U.S.C. 154(b) by 228 days.

(21) Appl. No.: 13/777,482

(22) Filed: Feb. 26, 2013

(65) Prior Publication Data

US 2014/0240056 A1 Aug. 28, 2014

(51) Int. Cl.
*H01P 5/10* (2006.01)

(52) U.S. Cl.
CPC ..... *H01P 5/10* (2013.01)

(58) Field of Classification Search
CPC ..... H03H 7/42; H01P 5/10
USPC ..... 333/25, 26; 336/200
See application file for complete search history.

(56) References Cited

U.S. PATENT DOCUMENTS

| | | | | |
|---|---|---|---|---|
| 4,994,755 | A | 2/1991 | Titus et al. | |
| 5,977,842 | A | 11/1999 | Brown et al. | |
| 6,097,273 | A * | 8/2000 | Frye et al. | 336/200 |
| 6,867,742 | B1 | 3/2005 | Irion, II et al. | |
| 6,891,446 | B2 | 5/2005 | Tayrani et al. | |
| 6,946,880 | B2 | 9/2005 | Essenwanger | |
| 7,176,776 | B1 * | 2/2007 | Tantwai et al. | 336/200 |
| 7,215,217 | B2 | 5/2007 | Ezzeddine | |
| 7,936,234 | B2 | 5/2011 | Wu et al. | |
| 8,259,027 | B2 | 9/2012 | Isom et al. | |
| 8,283,991 | B1 | 10/2012 | Essenwanger | |
| 2001/0040495 | A1 | 11/2001 | Morikawa | |
| 2005/0200425 | A1 | 9/2005 | McKay et al. | |
| 2006/0279374 | A1 | 12/2006 | Wu et al. | |
| 2009/0107701 | A1 | 4/2009 | Park et al. | |
| 2010/0315175 | A1 | 12/2010 | Ono et al. | |
| 2011/0102096 | A1 | 5/2011 | Jeong et al. | |
| 2012/0019333 | A1 | 1/2012 | White | |

FOREIGN PATENT DOCUMENTS

| | | |
|---|---|---|
| EP | 1 032 071 A1 | 8/2000 |
| JP | 56-51831 | 5/1979 |

OTHER PUBLICATIONS

Lee, et al.; "Synthesis of a Planar, Coupled-line Marchand Balun with Emphasis on Balance;"—http://www.microwavejournal.com/articles/print/1260-synthesis; Mar. 9, 2006; downloaded on Nov. 24, 2012; pp. 1-8.

Zhang, et al.; "A New Planar Marchand Balun;" Microwave Symposium Digest; IEEE MTT-S International; Jun. 12-17, 2005; 4 pages.

International Search Report of the ISA for PCT/US2013/028168 dated Nov. 22, 2013.

Written Opinion of the ISA for PCT/US2013/028168 dated Nov. 22, 2013.

* cited by examiner

*Primary Examiner* — John Poos

(74) *Attorney, Agent, or Firm* — Daly, Crowley, Mofford & Durkee, LLP

(57) ABSTRACT

Wideband balun having good performance characteristics for use in feeding differential antenna elements in array antennas, balanced amplifier circuits and other applications is described. Also described is a common mode isolation circuit suitable for integration with the balun.

20 Claims, 13 Drawing Sheets

SYMMETRIC BALUNS AND ISOLATION TECHNIQUES

FIELD

The concepts, systems, circuits, devices and techniques described herein relate generally to radio frequency (RF) circuits and more particularly to RF baluns.

BACKGROUND

As is known in the art, a balun is a circuit element often used to convert unbalanced transmission line inputs into one or more balanced transmission line outputs or vice-versa. Baluns operating at relatively low-frequencies (e.g., below 1 GHz) are generally provided using ferrite and air coil transformer technology to achieve high performance and relatively broad bandwidth.

There has, however, been a trend to employ baluns in a wide variety of different types of applications often requiring high-frequency and/or wideband operation. For example, baluns have been included in output stages of delta-sigma modulator direct digital synthesizers, Digital-to-Analog Converters (DACs), Analog-to-Digital Converters (ADCs), differential digital signaling, RF mixers, SAW filters, balanced amplifier circuit configurations, feeding differential antenna elements in array antennas and other antenna feeds, for example, antenna feeds for cognitive radio systems. All of these applications require a balun which operate over a relatively wide bandwidth and which are compatible with integrated circuits and capable of rejecting common mode energy from differential inputs or providing differential outputs lacking common mode energy.

For baluns operating at or above microwave frequencies, it has become increasingly more difficult to fabricate broadband baluns utilizing ferrite and air coil transformers. This has necessitated that other techniques be used. Baluns operating at such high-frequency bands generally are provided using distributed components rather than from ferrite and air coil technology. Such baluns often comprise quarter-wavelength matching elements or transformers having a size determined according to desired operating wavelengths (i.e. operating frequencies) of the balun. One disadvantage of this approach is that the operational frequency bands of such baluns are fundamentally narrow. Moreover, high frequency signals (e.g., microwave and millimeter wave signals) typically rely on single-ended and unbalanced anti-phase signals (i.e. a signal driven with reference to a ground), rather than balanced differential signals. Such single-ended signals may be beneficial in controlling electromagnetic interference. The corresponding structures, however, are not well suited to accommodate balanced differential signals, which are necessarily isolated from ground.

As is also known, three port balun structures and other differential lines typically do not provide good common mode isolation between the differential ports. For many circuit and array antenna applications, this limits system performance. In particular, differential fed, wide band antenna elements frequently excite a common mode excitation at large scan angles (e.g. at scan angles of about 45 degrees or greater) in an E-plane scan plane.

Prior art systems have used resistive common mode isolators implemented at the differential ports of the balun to terminate this excitation and improve overall array performance.

Other wideband antenna array structures which have encountered this common mode problem have developed solutions for mitigating the effect of this common mode excitation. Such solutions involve E-plane walls or shorting vias to place the common mode in cutoff. These solutions accomplish the goal of limiting the common mode, but at the expense of antenna bandwidth and performance. Other approaches for limiting the common mode include material shaping and/or the use of materials having a relatively low relative dielectric constant. Such materials, however, have undesirable properties from a processing and mechanical point of view and thus increase the cost of manufacturing the circuit. Furthermore, in many cases, the use of low relative dielectric constant materials is still not sufficient to eliminate the problems, particularly in those applications requiring relatively large operating bandwidths.

Thus, a significant design challenge is posed when seeking to provide baluns having both high performance characteristics and/or which operate at relatively high frequencies and/or over relatively wide operating frequency bandwidths while at the same time maintaining phase and amplitude balance. As noted above, balun performance may be a limiting factor in the performance of array antennas and in other RF/microwave systems. Additionally, it is desired to make the baluns small, such that one or more baluns can fit within a unit cell of an array antenna to enable the array antenna to achieve desired performance and functionality.

Conventional balun designs used in circuit and array antenna applications at microwave frequencies include so-called Marchand baluns. Marchand baluns, for example, have been realized in planar form utilizing microstrip technology to provide balun configurations which function over fractional bandwidths of between 6:1 and 9:1. Due to dispersions inherent in implementing microstrip circuits, the performance of such microstrip baluns degrades at higher operating frequencies, reducing the upper frequency band limit and the overall bandwidth of these circuits. This leads to amplitude and phase imbalance at the higher frequencies.

DoubleY baluns and similar configurations are also known and have been used to realize baluns having fractional bandwidths of 9:1 and greater (18:1 in some cases). However, such baluns typically suffer from one of two shortcomings depending upon the design. One shortcoming is they often require more space than is available within a unit cell once a transition to an appropriate transmission line mode is included. While compact designs are available in coplanar form, many systems (e.g. array antennas) require microstrip or stripline interfaces. Thus, another shortcoming is that baluns implemented in coplanar form require transitions from coplanar to microstrip and other transmission line implementations and such transitions are prohibitive in a small space due to the presence of a strong coplanar moding. Strong coplanar moding possesses multiple fundamentally different modes that require complex transitions to match with microstrip and stripline modes without the creation of resonances that degrade performance.

It would, therefore, be desirable to provide a balun having good performance characteristics at RF and microwave frequencies and/or over wide operating bandwidths and which are appropriate for use in feeding differential antenna elements in array antennas, balanced amplifier circuits and other applications.

SUMMARY

In accordance with the concepts described herein, a symmetric, stripline Marchand balun includes a first substrate having first and second opposing and a second substrate having first and second opposing surfaces. Transmission line conductors are disposed on one surface of each of the first and second substrates with conductive ground layers on the other surface. A central dielectric layer having a conductor provided therein is disposed between the surfaces of the substrates on which the conductors are disposed. The central dielectric layer equally spaces the substrate conductors from the conductor on the central dielectric layer (i.e. the substrate conductors are symmetrically disposed about the central dielectric layer), and in particular, are symmetrically disposed about the conductor in the central dielectric layer. The conductor on the central dielectric layer acts as both a signal and a ground such that the substrate conductors form a Marchand balun.

With this particular arrangement, a symmetric, stripline Marchand balun is provided. The central dielectric layer equally spaces the substrate conductors to thus form a double offset stripline stacked at close spacing. Thus, the central dielectric layer and conductor provided therein allows realization of closely spaced broadside coupled lines.

Described herein are concepts, circuits and techniques which utilize a symmetric stripline Marchand balun topology. In one particular embodiment, a fourth order Marchand balun topology is used. A balun circuit provided having a fourth order Marchand balun topology in accordance with the concepts described herein operates over a fractional bandwidth of up to 9:1. In one exemplary embodiment, a balun was built using soft substrate technology (i.e. printed circuit board (PCB) technology in which the circuit boards are fabricated in various materials, including, but not limited to low cost FR4-processed, ceramic-based materials, and lower loss, lower dielectric constant PTFE-based materials (i.e., CLTE, RO6002))

The Marchand balun topology may be provided as a symmetric stripline design implementable both with and without additional isolator sections, as needed for system performance. One exemplary stripline Marchand balun described herein operates over a fractional bandwidth of 6:1 or more.

Marchand baluns fabricated in accordance with the concepts and techniques described herein may be provided using low cost fabrication techniques (e.g. conventional printed circuit board (PCB) manufacturing techniques).

One exemplary implementation described herein utilizes multilayer PCB technology that is low cost and scalable. Thus, such embodiments are suited for use with relatively large array antennas. In one embodiment, the baluns described herein can be fabricated on 18"×24" and 24"×36" substrates (e.g. panels) which can be integrated with antenna elements on the same panels to thus provide relatively large array antennas.

In one embodiment, the baluns described herein utilize backdrill vias and/or Ormet paste technology to interconnect interior layers and thus reduce the occurrence of, or ideally prevent, excitation of higher order RF signal modes. Reducing (or ideally preventing) the occurrence of higher order RF signal modes, improves system performance. For example, array antenna systems using the balun concepts described herein operate over bandwidths which are wider than that allowed by the use of conventional baluns. Also, array antenna systems using the balun concepts described herein operate at frequencies which are wider bandwidth than achieved with the use of conventional baluns.

In one embodiment, a balun utilizes a double offset stripline stacked at close spacing to realize broadside coupled lines. This increases the operating bandwidth of the balun and also provides the necessary transition from balanced to unbalanced performance.

Furthermore, the double offset stripline configuration allows relatively easy integration of isolator sections within the balun.

In one embodiment, the addition of a resistive common mode isolator integrated at differential ports of a balun improves a balun isolation characteristic. In one exemplary embodiment, balun isolation improves from a level of roughly 6 dB to levels better than 20 dB without any increase in the size of the balun (i.e. without increasing the surface area which the balun occupies on a circuit board which includes, for example, a stripline or mircostrip PCB).

Multiple isolators can be cascaded in a manner similar to adding resistive sections to a Wilkinson power divider to further improve isolation at the expense of balun/isolator footprint. These additional sections are simply added on the differential lines of the baluns using either the common mode isolation technique described here or other well-known common mode isolation techniques. By improving the isolation, the common mode excitation is reduced or ideally terminated and thus prevented from resonating across the face of an array antenna. This improves bandwidth and performance by preventing large nulls from appearing in the frequency band as a result of the common mode.

In one embodiment, the resistive common mode isolators are realized within the same PCB stackup as the balun. The common mode isolators are placed over the differential matching section of the balun. The common mode isolator uses broadside coupled lines located proximate to the differential matching section. These isolator lines are shorted together on one end, and then connected together to a resistor connected to ground on the other end. This resistive connection is invisible to the differential mode, but provides an excellent common mode termination.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

In general overview, described herein is a Marchand balun implemented using a double offset stripline stacked at a relatively "close" spacing (generally 0.001"-0.003", but in the range of about 0.0001 to about 0.010" for some applications). Such relatively close spacing is needed to realize desired coupling levels between the conductors in the stripline circuit. Significantly, the stripline conductors which form the Marchand balun are symmetrically disposed about a conductor provided in a center dielectric layer. The center dielectric layer is disposed between a pair of substrates each of which have a ground plane disposed on one surface thereof and strip conductors disposed on another surface thereof. The center dielectric layer thus dielectrically spaces or offsets the substrate conductors from each other by an amount which is symmetric about the conductor provided in a center dielectric layer (hence providing the "double offset stripline" structure). When disposed proximate each other, the substrate conductors form the Marchand balun structure.

In some exemplary embodiments described herein, the central dielectric layer is provided as a bond layer. Thus, in such exemplary embodiments the central dielectric layer functions to both dielectrically space conductors disposed on the substrates and also bind together the two substrates so as to provide a bonded (or laminated) multilayer printed circuit board.

Significantly, conductors on the first and second substrates (i.e. the substrate conductors) must be symmetrically disposed about (i.e. symmetrically spaced) from the conductor provided in the central dielectric layer.

In one particular embodiment described herein, the symmetric spacing of the conductor in the central dielectric layer is achieved by providing the central dielectric layer from a pair of bond film layers disposed on either side of a conductor such that the pair of bond film layers have the conductor embedded substantially in the center thereof. By providing each of the bond film layers having a thickness in the range of about 0.001-0.005 inches the substrate conductors (i.e. the conductors on the substrate surfaces) can be closely spaced but dielectrically insulated from each other via the bond layers.

Figure 1:
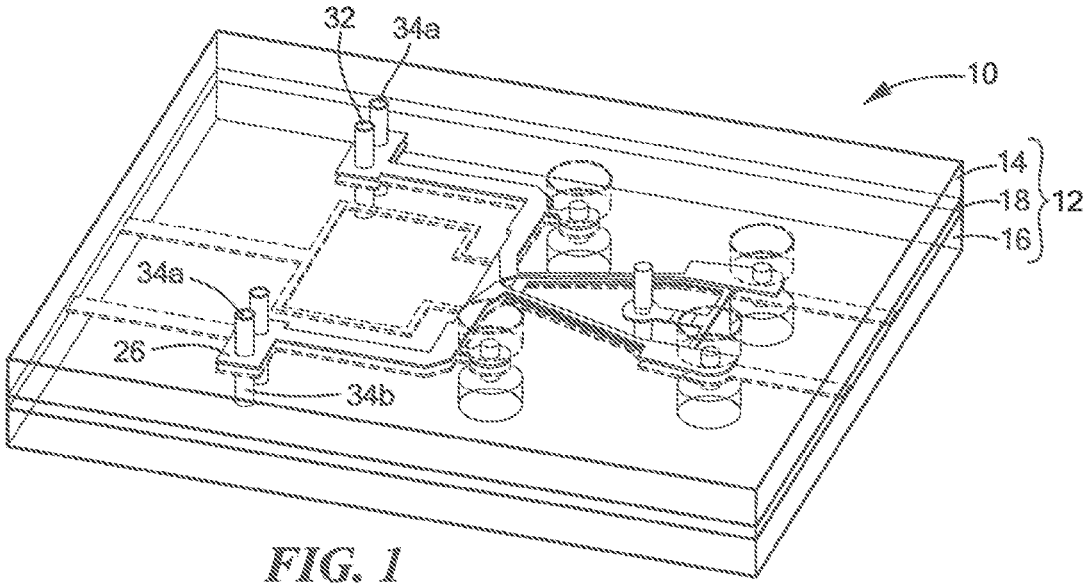
FIG. 1 is an isometric view of a symmetric stripline five (5) port Marchand balun which utilizes conductive vias provided using a backdrill and fill technique.
Figure 1A:
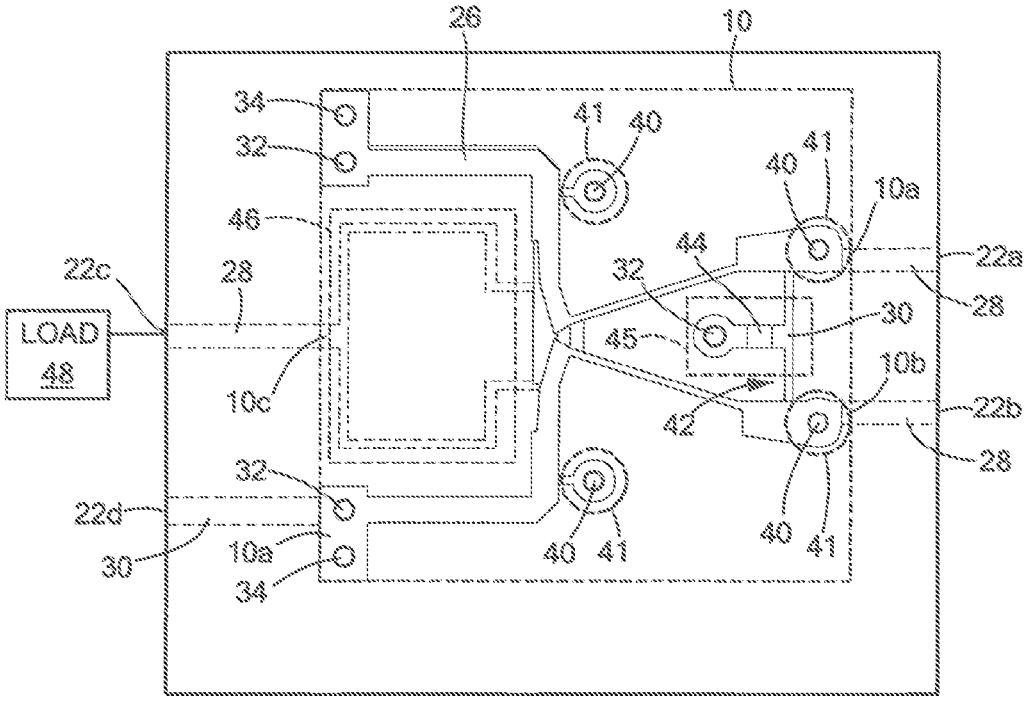
FIG. 1A is a plan view of the symmetric stripline five (5) port Marchand balun shown in FIG. 1.
Figure 1B:
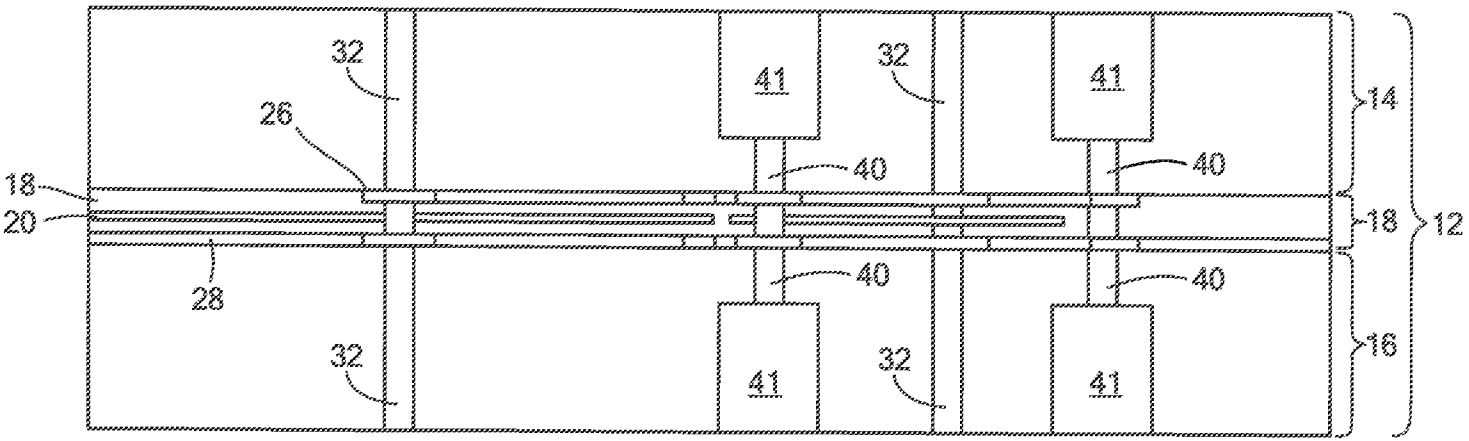
FIG. 1B is a side view of the symmetric stripline five (5) port Marchand balun shown in FIGS. 1 and 1A.

Referring now to FIGS. 1-1B in which like elements are provided having like reference designations throughout the several views, a symmetric stripling Marchand balun 10 having five (5) ports 10*a*-10*e* and is provided from a multi-layer printed circuit board (PCB) 12 comprising a pair of substrates 14, 16 (FIG. 1B). Each substrate has first and second opposing surfaces and ground plane layer is disposed over at least one surface of each substrate.

A bond layer 18 is disposed between the two substrates 14, 16 to fasten or otherwise secure substrates 14, 16 into a single multi-layer printed circuit board (PCB).

A conductor 20 is disposed substantially in the center of the bond films and is thus spaced apart from the surfaces of substrates 14, 16. With this configuration, the multi-layer PCB 12 is said to have five (5) layers as follows: each surface of the first and second substrates 14, 16 corresponds to a layer and conductor 20 corresponds to a layer. To promote clarity in the description provided herein the layers will be designated herein as follows: layer 1 top surface of substrate 14 (FIG. 1B); layer 2—bottom surface of substrate 14 (FIG. 1B); layer 3—conductor 20 (FIG. 1B); layer 4—top layer of substrate 16 (FIG. 1B); and layer 5—bottom surface of substrate 18 (FIG. 1B).

In one exemplary embodiment, bond layer 18 is provided from a pair of bond films each having a pre-bond thickness of about 0.0029 inch and conductor 20 is disposed between the two bond films. This provides approximately a 0.0015 inch dielectric separation between conductor 20 and conductor layers. Marchand balun 10 has four parts 10*a*-10*d* each of which is coupled to a respective one of four transmission ones 22*a*-22*d*. While transmission lines 22*a*-22*d* are not properly a part of Marchand balun 10, they provide access to (or a means to couple signals to/from) balun ports 10*a*-10*d*.

Marchand balun 10 is provided from a plurality of conductors disposed on layers 2, 3 and 4.

Conductors 26 are disposed (e.g. patterned or otherwise provided using, a subtractive and/or an additive process) on layer 2 in the configuration shown in FIG. 1A and conductors 28 are disposed on layer 4 in the configuration shown in FIG. 1A. Conductor 30 is disposed on layer 3 in the configuration shown in FIG. 1A.

Conductive vias 34, extend through the entire multi-layer PCB 12 such that vias 34 provide a conductive signal path between conductive ground planes on PCB layers 1 and 5. Thus, any conductor (e.g. conductor 30 in the region proximate ports 20*d* and 22*d*) electrically connected to one of vias 34 is also connected to the ground planes through those vias. In this via implementation, ground loop currents have a shortened path to ground which helps eliminate resonances in Marchand balun 10. In this exemplary embodiment, conductive vias are provided as conductively filled vias (e.g. solid conductive solid posts) but other types of vias (e.g. hollow vias or plated vias that are dielectrically filled with products such as SanEI PHP900 of Peters 2795 fill materials) or other techniques for providing a conductive signal path between the ground planes may, of course, also be used.

Conductive vias 32 are disposed proximate vias 34, however, these vias are provided from two separate vias with a first portion 34*a* coupled between layers 1 and 2 and a second portion 34*b* thus coupled between layers 4 and 5. Conductive vias 34 thus couple conductors disposed on layers 2 and 4, respectively, such that the layer 2 and 4 conductors act as ground planes for conductors disposed on layer 3 (e.g. conductor 30).

In one embodiment, substrates 14, 16 are provided having a thickness of about 0.020 inches and a relative dielectric constant ($\in_r$) of about 2.85. Bond layer 18 is provided having a relative dielectric constant ($\in_r$) selected to be close (and in preferred embodiments substantially match) the dielectric constant of the substrates 14, 16. In this exemplary embodiment, bond layer 20 is provided as a so-called pre-preg layer having a relative dielectric constant of about 2.9.

In one exemplary embodiment, conductive vias 32 are provided having a diameter of about 0.008 inch and conductors 26, 28, 30 are provided having a thickness of about 0.0012 inch.

Conductive vias 40 are provided using a conventional backdrill technique (in this exemplary embodiment, a conventional 0.028 inch backdrill and fill technique is used) and provide connections between layers 2 and 4. The backdrilled holes are filled with a hole plugging material 41 (e.g. TAIYO THP-100DXI or similar). A conductor is then disposed over the filled regions to provide layers 1 and 5 having a continuous ground plane in the regions above conductive vias 40. Techniques other than backdrilling and filling techniques may also be used to provide conductive vias 40.

A conductive signal path 42 (provided from a conductor 30) on layer 3 extends between Marchand balun ports 10*a*, 10*b*. A resistive isolator 44 is placed between conductive path 42 and ground. Resistive isolator 44 enhances common mode attenuation in the balun.

Marchand balun 10 further includes a second common mode attenuation circuit 46 to further increase common mode attenuation in the balun. In the exemplary embodiment of FIGS. 1-1B, an external load 48 (FIG. 1A) is coupled to common mode attenuation circuit 46. It should, of course, be appreciated that external load 48 may also be provided as an internal (or in-circuit) load. In some applications, an external load may be preferred to allow for additional power handling capability (i.e. the physical dimensions or size of load 48 in high power applications may make it inappropriate for use as an in-circuit load).

It should be appreciated that depending upon the needs of a particular application, either one or both of common mode attenuation circuits 45, 46 may be provided as part of balun 10. Furthermore, in some applications both of common mode attenuation circuits may be omitted.

In operation, a pair of balanced signals 180° out of phase provided to respective ones of input ports 22*a*, 22*b* (e.g. 70 ohm balanced signals) appear at port 22*d* as a 50 ohm balanced signal.

Alternatively, a signal provided to port 22*d* (e.g. a 50 ohm unbalanced signal) is coupled to ports 22*a* and 22*b* and are provided as two signals 180° out of phase (e.g. 70 ohm balanced signals).

Figure 2:
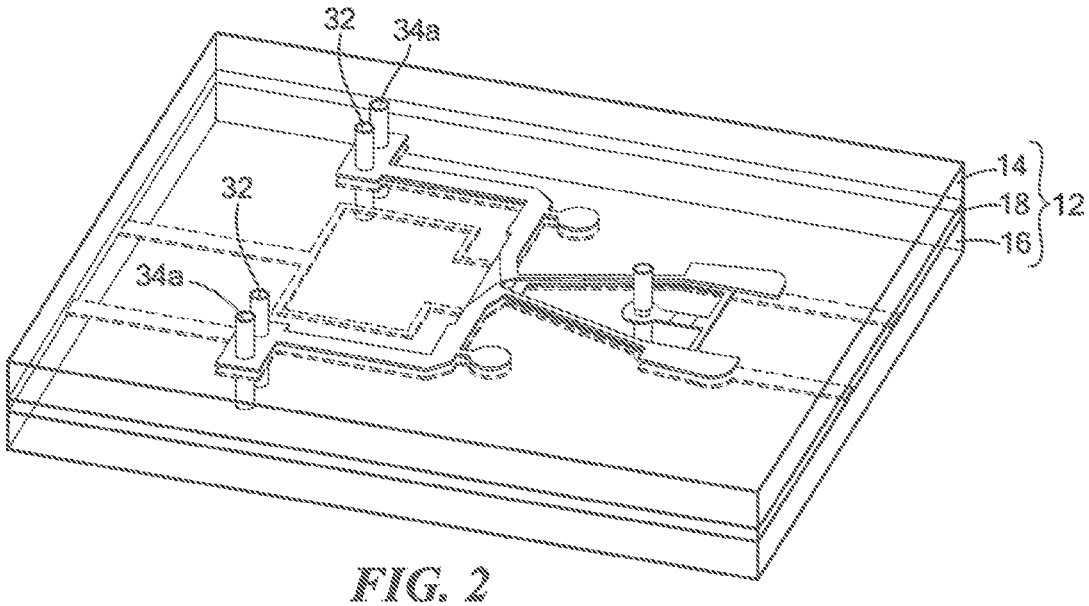
FIG. 2 is an isometric view of a symmetric stripline five (5) port Marchand balun having interlayer interconnects.
Figure 2A:
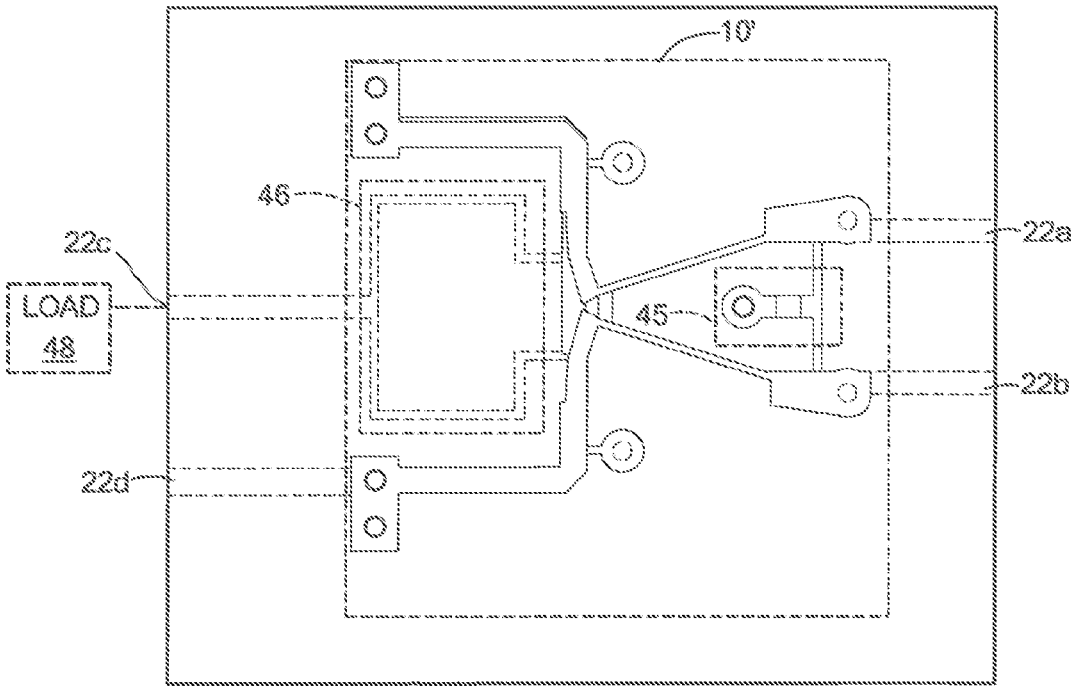
FIG. 2A is a plan view of the Marchand balun of FIG. 2.
Figure 2B:
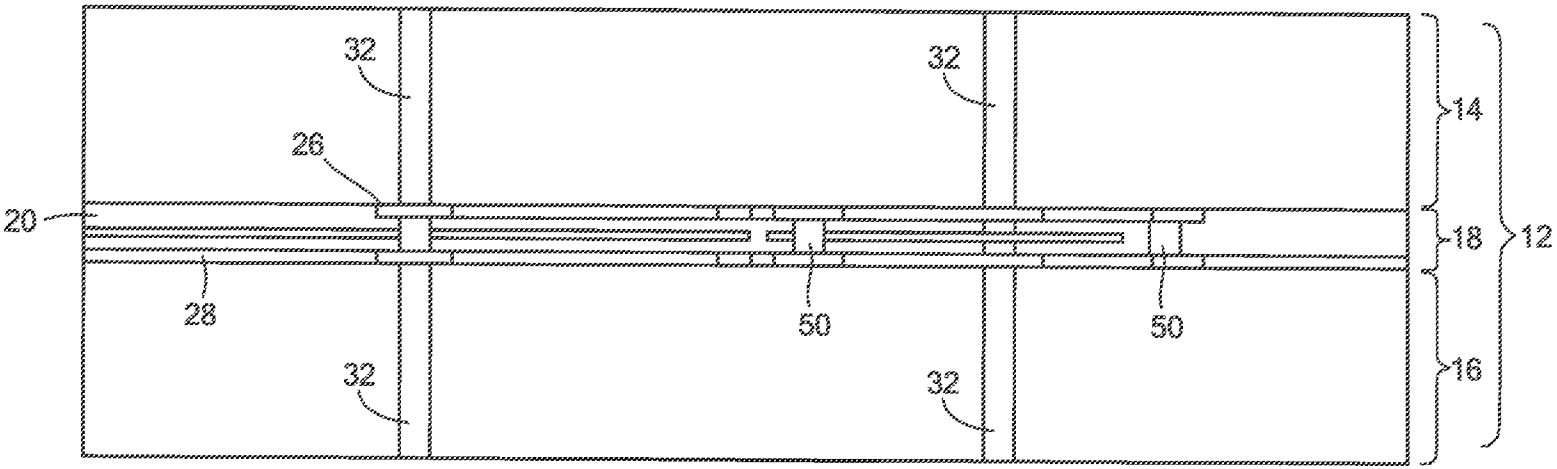
FIG. 2B is a side view of the Marchand balun shown in FIGS. 2 and 2A.

Referring now to FIGS. 2-2B, an alternate embodiment of a Marchand balun 10' is shown. In this embodiment, layers 2 and 4 are electrically coupled using one or more interconnects 50. In one exemplary embodiment, four interconnects 50 are used between layers 2 and 4 (two interconnects on each side). The interconnect should be spaced close enough to prevent higher order modes between layers 2 and 4 from being excited and propagated as leakage modes.

In one exemplary embodiment, interconnects 50 are provided via Ormet paste applied within bond layer 18. Ormet paste is applied in trimmed out prepreg areas to allow layer to layer conductive connection. The addition of interconnects 50 improves the performance of the device by reducing and eliminating higher order mode leakage. This improves high frequency insertion loss performance. It should, of course, be appreciated that any technique for providing a conductive signal path between layers 2 and 4 may also be used.

Figure 3:
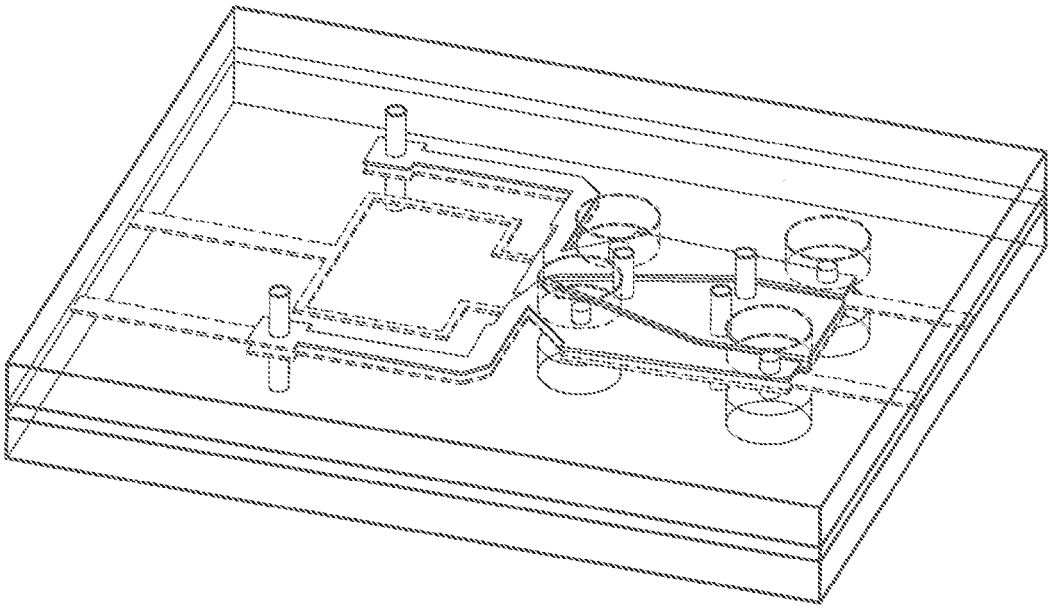
FIG. 3 is an isometric view of a symmetric stripline four port Marchand balun.
Figure 3A:
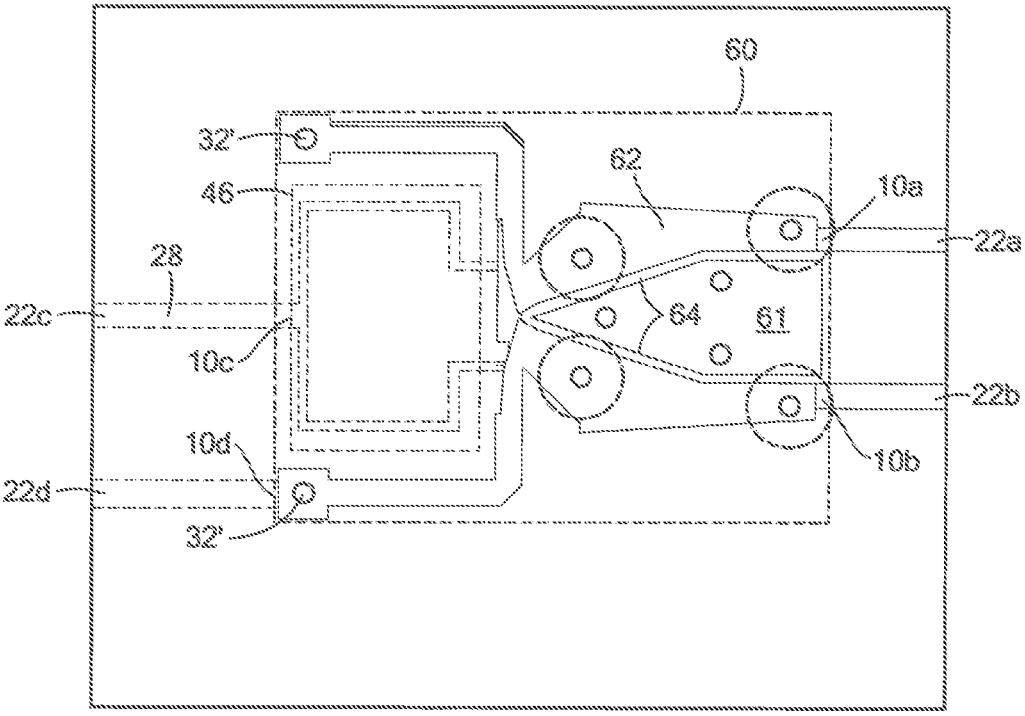
FIG. 3A is a plan view of the Marchand balun shown in FIG. 3.
Figure 3B:
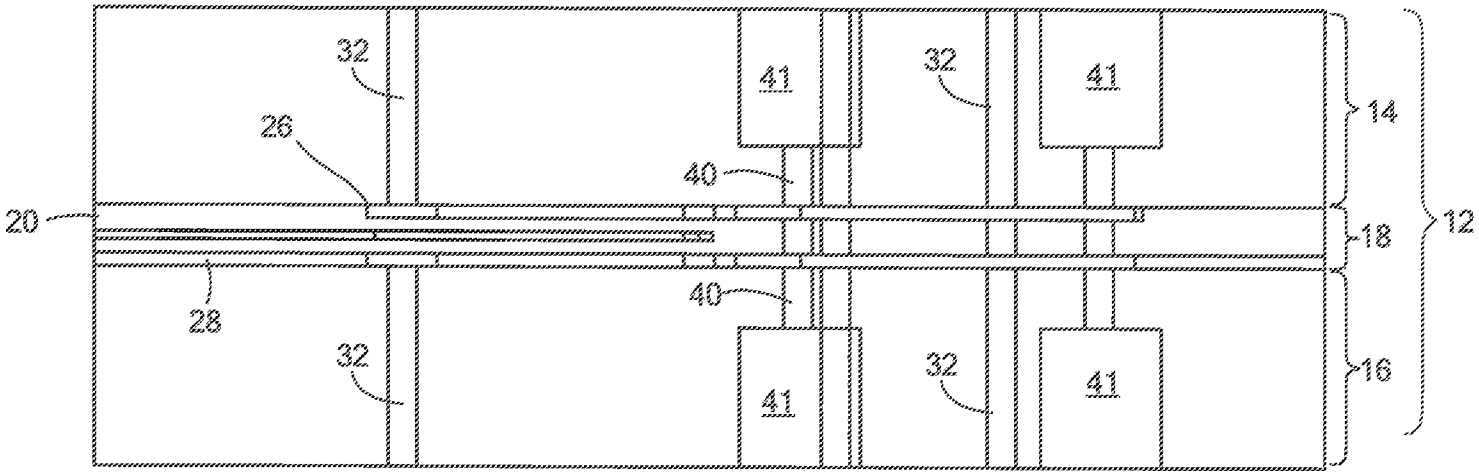
FIG. 3B is a side view of the Marchand balun shown in FIGS. 3 and 3A.

Referring now to FIGS. 3-3B, in which like elements of FIGS. 1-2B are provided having like references designations throughout the several views, a Marchand balun 60 is provided having a conductor 62 disposed on layer 2 for the purpose of providing improved low frequency performance by tightly coupling two arms to promote a coplanar waveguide mode. This technique both improves field containment within the transmission lines which form the balun and also serves to lower the impedance which improves balun performance by, inter alia, lowering insertion loss characteristics of the balun.

The particular shape of wedge portion 61 is selected to reduce, and preferably minimize, a distance between a transmission line section and a ground plane disposed on the same layer as the transmission line. The ability to closely space the transmission line from the ground plane is an important factor to consider in selecting the shape of wedge portion 61.

It should be appreciated that balun 60 includes conductive vias 32' which may be the same as or similar to conductive vias 32 described above in conjunction with FIGS. 1-1B. It should also be appreciated that balun 60 could benefit from the double via structure described above in conjunction with FIG. 1 (i.e. the use of two vias such as vias 32, 34 in FIG. 1). Balun 60 also includes vias 40' which may be the same as or similar to vias 40 described above in conjunction with FIGS. 1-1C (i.e. provided using a backdrill and fill technique as described in conjunction with FIGS. 1-1B).

It should be noted that portions of conductor 62 have been removed to expose dielectric channels 64. The purpose of channel 64 is produce strong coplanar coupler realizing the benefits mentioned above.

Figure 4:
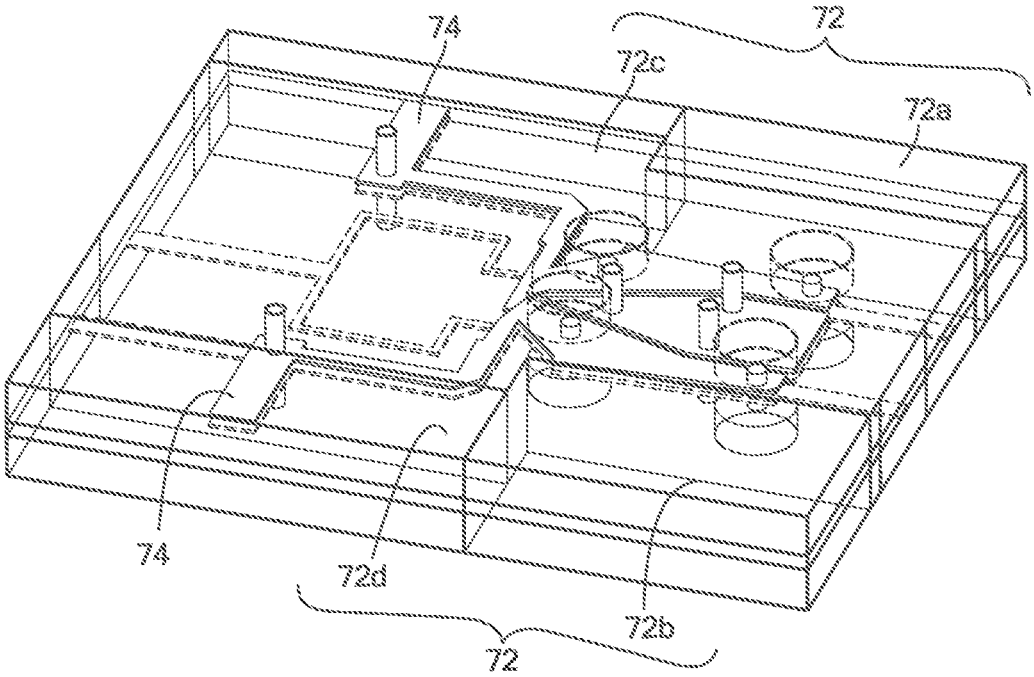
FIG. 4 is an isometric view of a symmetric stripline five (5) port Marchand balun utilizing backdrilled and filled conductive vias.
Figure 4A:
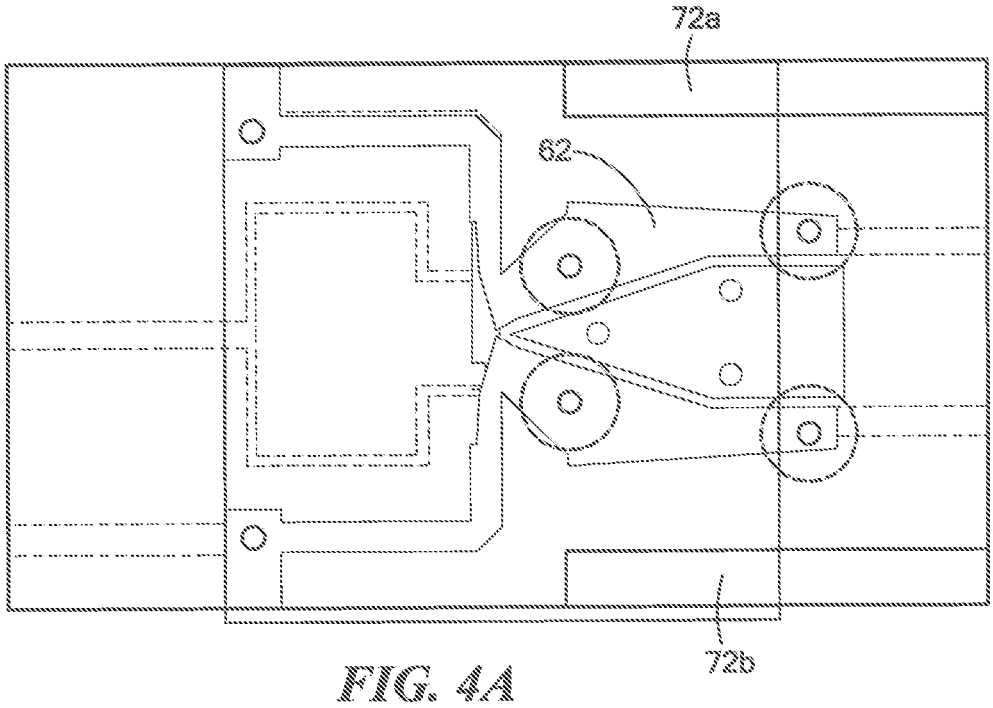
FIG. 4A is a plan view of the symmetric stripline five (5) port Marchand balun shown in FIG. 4.
Figure 4B:
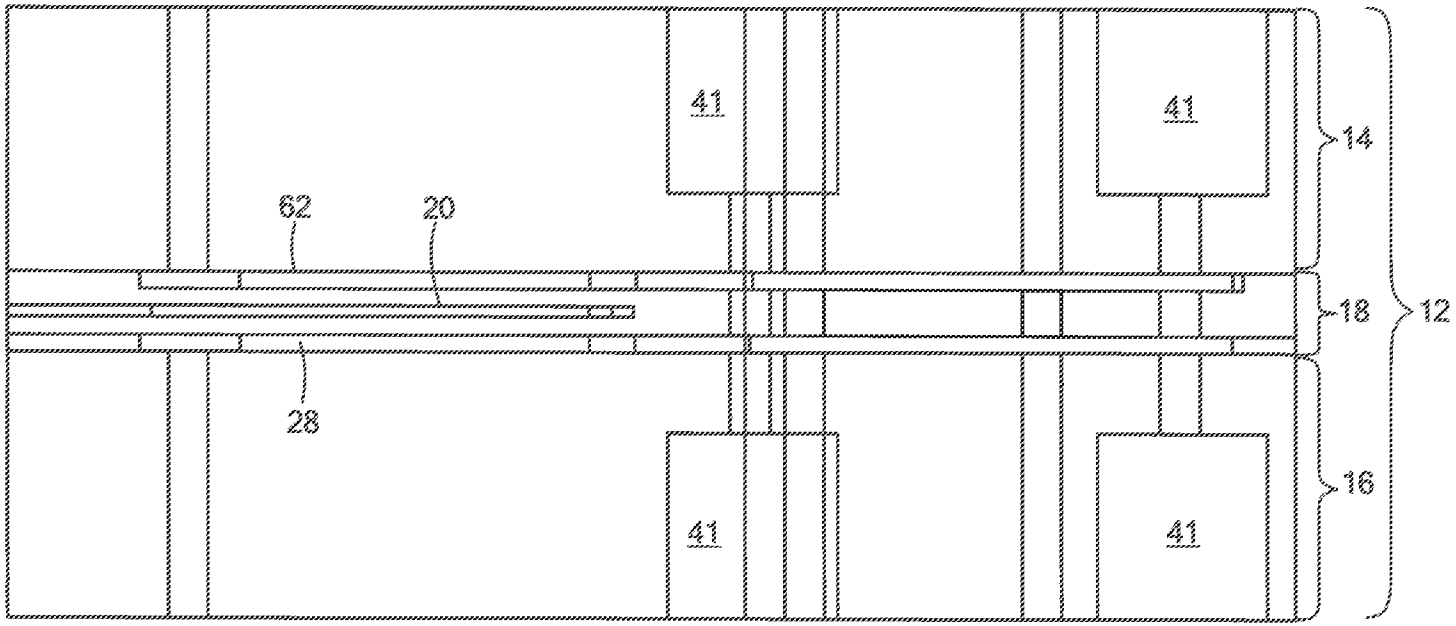
FIG. 4B is a side view of the symmetric stripline five (5) port Marchand balun shown in FIGS. 4 and 4A.

Referring now to FIGS. 4-4B, in which like elements of FIGS. 1-3B are provided having like reference designations throughout the several views, a balun 70 further includes a plurality of ground blocks here four ground blocks 72*a*-72*d* generally denoted 72, with a respective one of ground blocks 72*a*-72*d* disposed in a respective one of each quadrant of the balun. It should be appreciated that although four ground blocks are shown in this exemplary embodiment, in other embodiments fewer or more than four ground blocks may be used. Each ground block 72 may be implemented by providing a plurality of conductive vias which extend between top and bottom ground planes of the balun (i.e. ground planes on layers 1 and 5). The conductive vias act as mode suppression vias. By using four ground blocks with one disposed in each balun quadrant, the ground blocks 72 serve to electrically "cage" the device (i.e. the ground blocks 72 form an RF cage around the balun so as to reduce, or in some cases substantially eliminate, RF signals radiating (i.e. "leaking") outside the balun circuit).

In one exemplary embodiment, in which the balun operates over a frequency range of about 3 GHz to about 19 GHz the conductive vias are provided having a diameter of about 0.008" and are disposed in a rectangular grid pattern with a center-to-center spacing of about 0.04". In other embodiments, different vias may be provided having different diameters and may be disposed in a pattern other than a rectangular grid (e.g. a triangular lattice, a series of concentric circles, or any other regular or irregular pattern may also be used). After reading the disclosure provided herein, one of ordinary skill in the art will understand how to select the sizes, shapes and patterns of the vias for a particular application. Thus, in view of the above, it should also be understood that ground blocks 72 may be provided having any shape (e.g. including but not limited to square, rectangular or triangular cross-sectional shapes as well as any other regular or irregular cross-sectional shape as well as any volumetric shape—e.g. cube, pyramidal, prism of any number of sides, etc. . . . ).

The balun further includes conductive extension regions 74 which improve electrical coupling with ground blocks 72. Extension regions 74 are extended to intersect with the conductive vias with the ground blocks 72. The extension region must intersect with at least one individual via among the plurality in the ground blocks 72 to realize the performance improvement.

Figure 5:
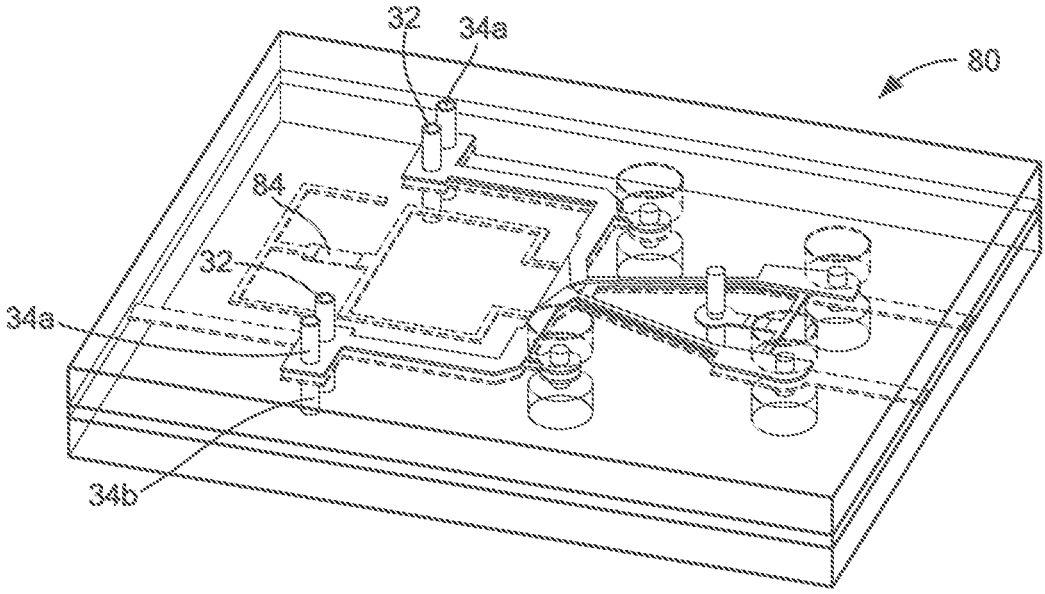
FIG. 5 is an isometric view of a symmetric stripline five (5) port Marchand balun having open circuit isolator stubs and a common mode isolation circuit.
Figure 5A:
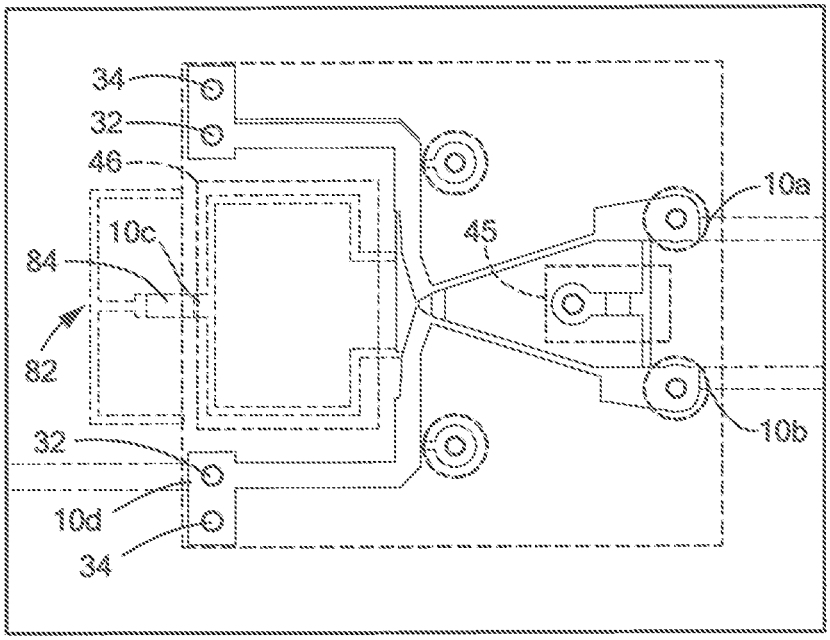
FIG. 5A is a plan view of the symmetric stripline five (5) port Marchand balun shown in FIG. 6.
Figure 5B:
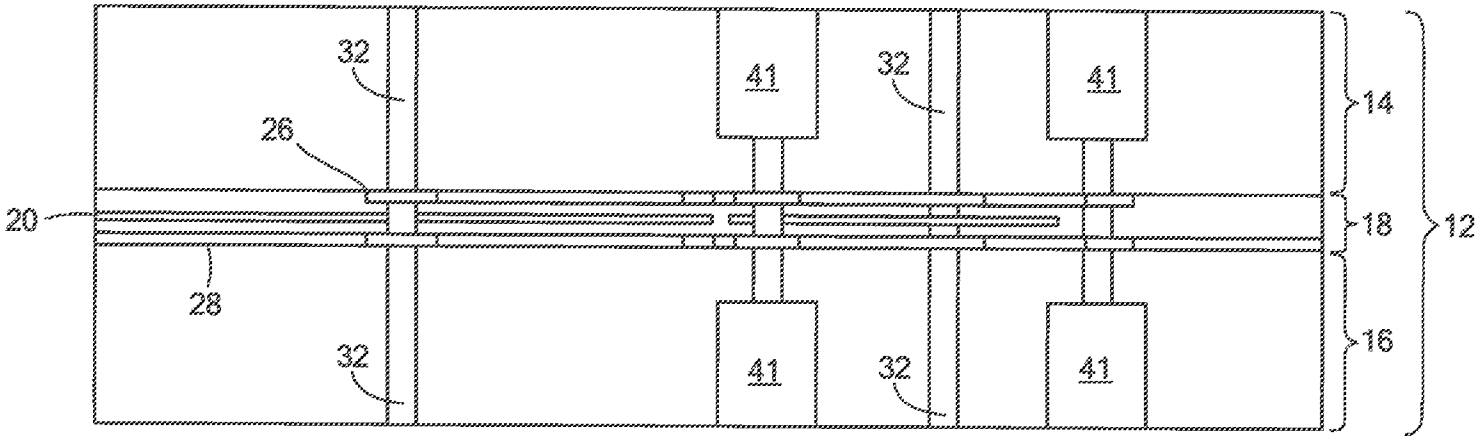
FIG. 5B is a side view of the symmetric stripline five (5) port Marchand balun shown in FIGS. 5 and 5A.

Referring now to FIGS. 5-5B, in which like elements of FIGS. 1-4B are provided having like reference designations throughout the several views, a symmetric stripline March-and balun 80 implemented as a stripline multilayer PCB 12 includes an open circuit isolator stub 82 coupled through a resistive load 84 to balm port 10*c*. The shape of open circuit stub 82 may be selected to suit the needs (e.g. geometry and available area) of a particular application. In the exemplary embodiment of FIG. 5, circuit 82 is provided as a symmetric circuit, but other embodiments need not be symmetric. Also, the line widths of the conductors which comprise the stub circuit 82 are selected to enhance the effectiveness of termination 84 (here shown as a resistor, but other termination impedances may also be used including terminations having complex impedances).

Figure 6:
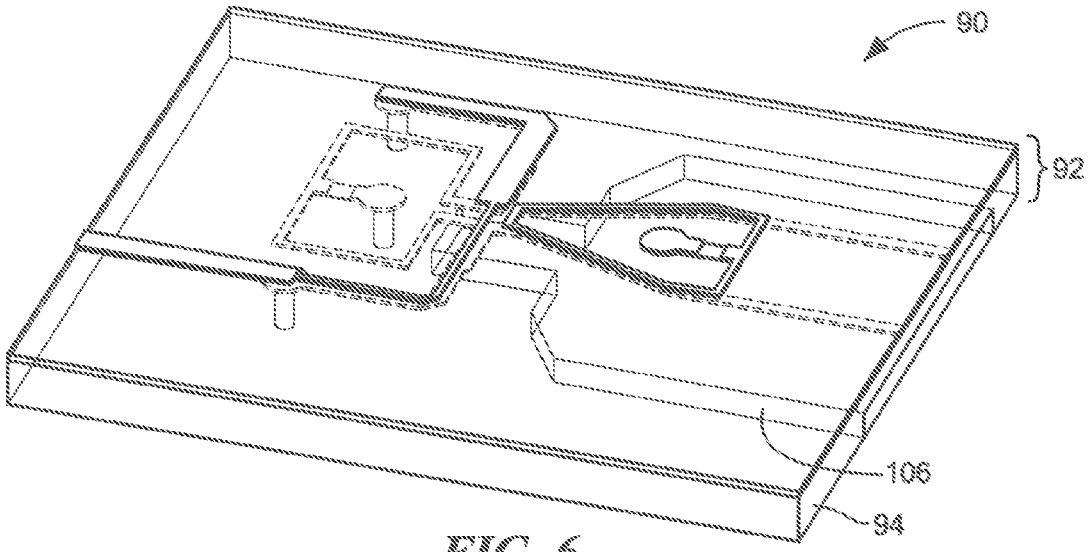
FIG. 6 is an isometric view of a five (5) port Marchand microstrip balun having two (2) isolators.
Figure 6A:
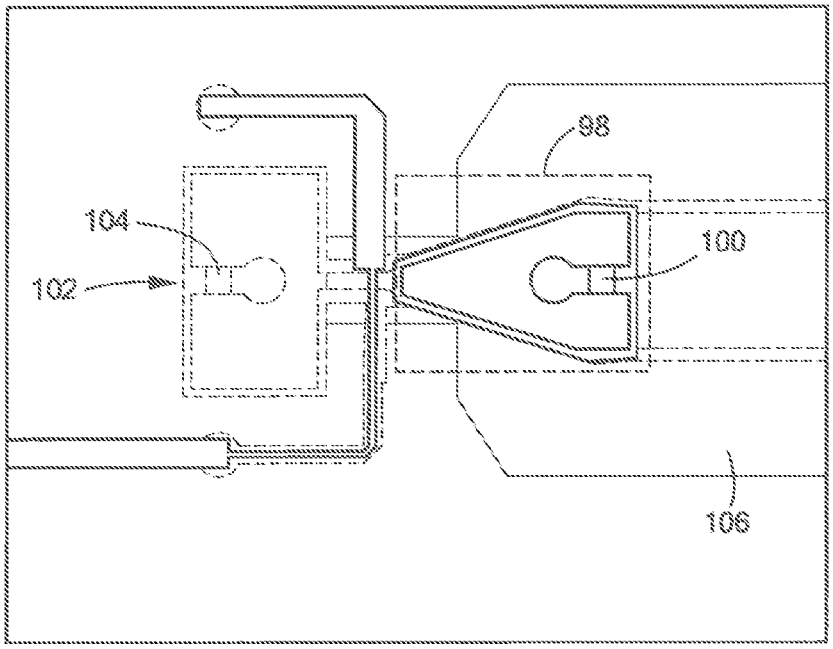
FIG. 6A is a plan view of the five (5) port Marchand microstrip balun of FIG. 6.
Figure 6B:
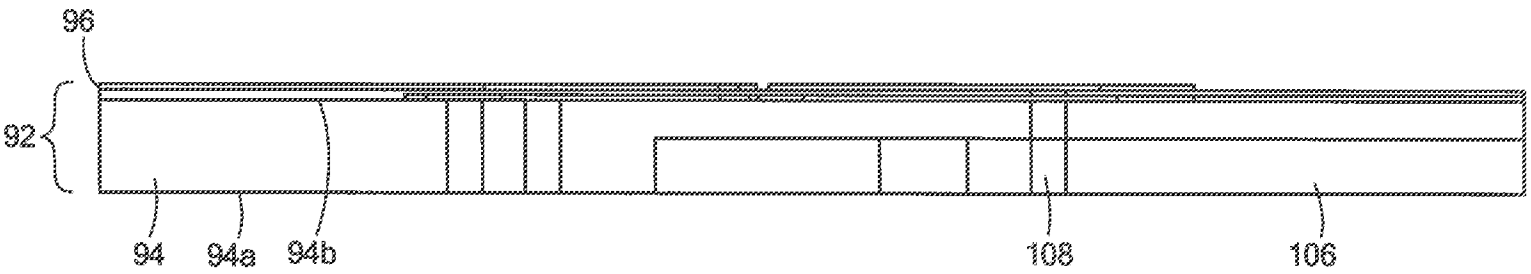
FIG. 6B is a side view of the five (5) port Marchand microstrip balun of FIGS. 6, 6A.

Referring now to FIGS. 6-6B in which like elements are provided having like reference designations throughout the several views, a Marchand balun 90 implemented in microstrip is provided from a multilayer PCB 92 comprising a substrate 94 having first and second opposing surfaces 94*a*, 94*b* with a ground plane disposed over surface 94*a* and a substrate 96 having a first surface disposed over surface 94*b* of substrate 94.

In this embodiment, balun 90 includes a common mode isolator circuit 98 comprising a resistor 100 (provided as a 60 ohm resistor in the exemplary embodiment of FIGS. 6-6B). Balun 90 includes a pair of 70 ohm balanced ports 90*a*, 90*b* and a 50 ohm unbalanced port 90*c*. A short circuit isolator 102 is coupled to balun port 90*d*.

Balun 90 further includes a mode suppression circuit 106 disposed in substrate 94 in the region in which conductors are disposed to provide the Marchand balun (i.e. mode suppression circuit 106 is disposed below the conductors which make up the Marchand balun. It should be appreciated that the conductors which provide the common mode isolator circuit 98 also provide part of the balun circuit itself (i.e. the isolator circuit is formed as part of the balun which results in the balun experiencing no increase in size.

Mode suppression region 106 may be provided from a plurality of conductive vies 108 (FIG. 6B) coupled between layer 3 and ground (i.e. layer 4). Although only one conductive via 108 is illustrated in FIG. 6B, it should be appreciated that region 106 is flooded with such conductive vias.

Figure 7A:
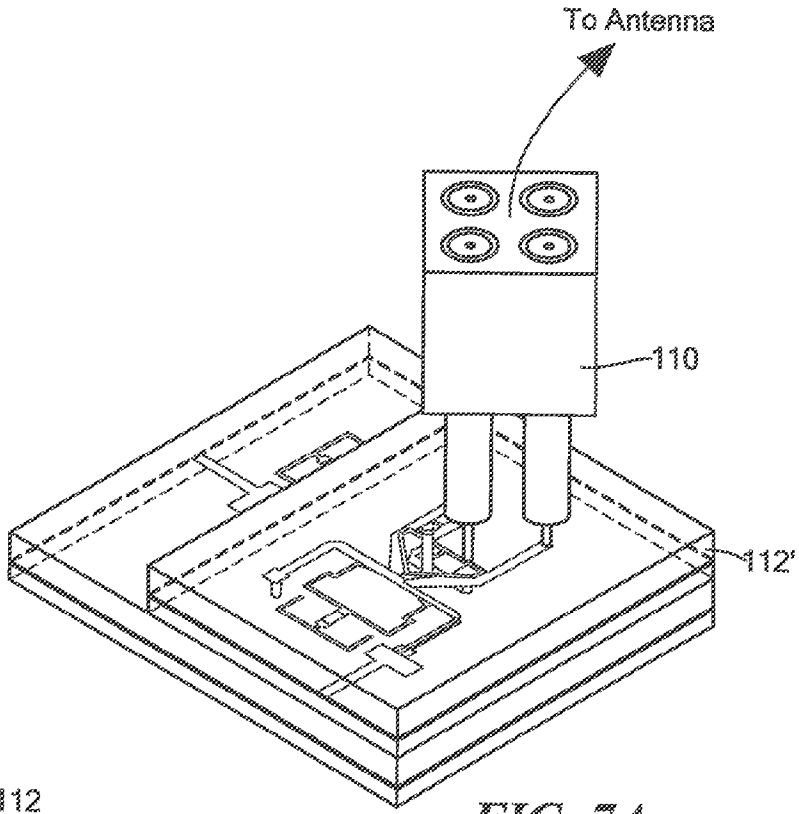
FIG. 7A is an isometric view of a symmetric stripline Marchand balun coupled to an antenna feed circuit.
Figure 7:
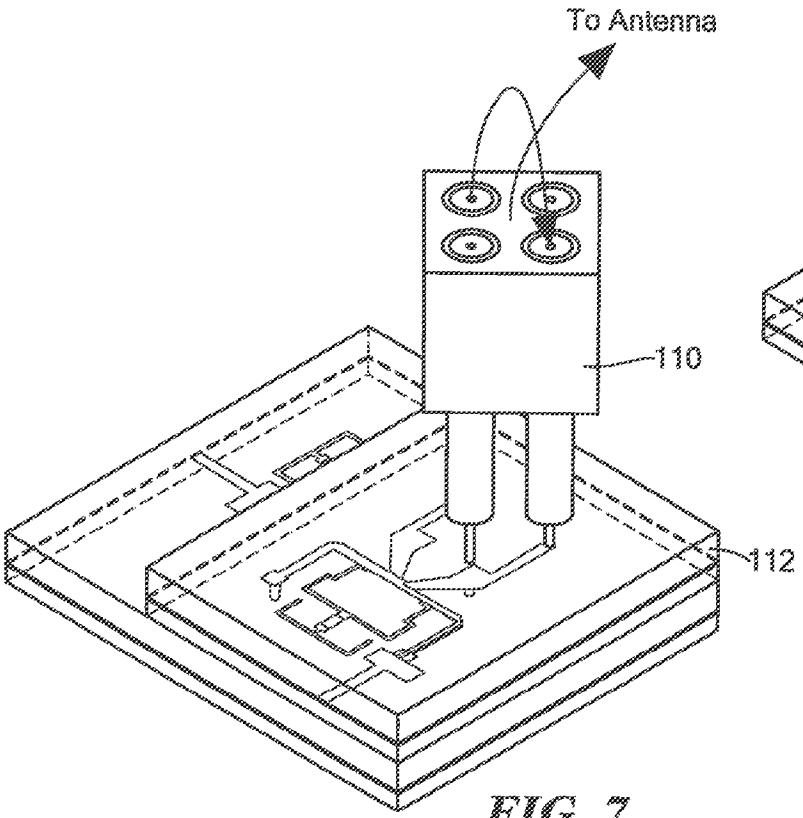
FIG. 7 is an isometric view of a symmetric stripline Marchand balun coupled to an antenna feed circuit.

Referring now to FIGS. 7 and 7A the baluns described herein can be stacked such that it is possible to have additional layers in a unit cell (e.g. 9 layers rather than just 5 layers. As shown in FIGS. 7, 7A coaxial feed lines 110 are coupled between a balun 112, 112' (FIG. 7A) and an antenna (not shown in FIGS. 7, 7A). It should be noted that balun 112 (FIG. 7) does not utilize an isolation circuit while balun 112' (FIG. 7A) does utilize an isolation circuit.

While particular embodiments of the present invention have been shown and described, it will be apparent to those skilled in the art that various changes and modifications in form and details may be made therein without departing from the spirit and scope of the invention as defined by the following claims. Accordingly, the appended claims encompass within their scope all such changes and modifications.

The invention claimed is:

1. A balun comprises:

first and second substrates, each of the first and second substrates having a first surface having a ground plane disposed thereon and having a plurality of conductive transmission lines disposed on a second surface thereof; and a center dielectric layer having a conductor provided along a center thereof so as to form a double offset stripline with at least some of the plurality of conductive transmission lines disposed on the second surface of the first and second substrates, said center dielectric layer disposed between the second surfaces of said first and second substrates such that said center dielectric layer dielectrically spaces the plurality of conductive transmission lines disposed on the respective second surfaces of said first and second substrates by an amount which is substantially symmetric about the conductor provided in said center dielectric layer and wherein, when disposed proximate each other, the plurality of conductive transmission lines disposed on the respective second surfaces of said first and second substrates substrate conductors form a symmetric, stripline Marchand balun.

2. The balun of claim 1 wherein said central dielectric layer is provided as a bond layer which dielectrically spaces the plurality of conductors disposed on the second surface of said first and second substrates and also bonds together said first and second substrates so as to provide a bonded multilayer printed circuit board.

3. The balun of claim 2 wherein said central dielectric layer is from a pair of bond film layers disposed on either side of a conductor such that the pair of bond film layers have the conductor embedded substantially in the center thereof.

4. The balun of claim 1 further comprising one or more isolator sections provided from conductors disposed on at least one of said central dielectric layer; or the second surface of said first and second substrates.

5. The balun of claim 4 wherein at least one of said isolator sections comprises a common mode isolator integrated at a differential port of the Marchand balun.

6. The balun of claim 5 wherein said common mode isolator is disposed over a differential matching section of the Marchand balun.

7. The balun of claim 6 wherein said common mode isolator comprises broadside coupled lines located proximate the differential matching section of the Marchand balun.

8. The Marchand balun of claim 7 further comprising a resistive element having a first terminal and a second terminal and wherein the broadside coupled lines of the isolator lines are electrically coupled so as to provide a short circuit impedance characteristic at one end and having a second end coupled to the first terminal of said resistive element and wherein the second terminal of said resistive element is coupled to ground.

9. The balun of claim 1 wherein said first and second substrates and said center dielectric layer form a five (5) layer printed circuit board.

10. The balun of claim 1 further comprising:

an open circuit isolator stub; and a resistive load wherein the open circuit isolator stub is coupled through the resistive load to a port of the symmetric stripline Marchand balun.

11. A symmetric stripline Marchand balun comprising:

a stripline coupled-line set including a first set of strip conductors disposed on a first side of a first substrate and a second set of strip conductors disposed on a first side of a second different substrate; and a central substrate disposed between the first and second set of strip conductors such that said first and second strip conductors are dielectrically spaced apart by said central substrate and symmetrically disposed about a conductor provided in a mid-line plane of said central substrate so as to form a double offset stripline balun.

12. The symmetric stripline Marchand balun of claim 11 wherein said first and second substrates are provided as soft substrates.

13. The symmetric stripline Marchand balun of claim 11 further comprising a plurality of ground blocks disposed to form an RF cage around said the first and second set of strip conductors.

14. The symmetric stripline Marchand balun of claim 11 further comprising a plurality of conductive vias, with at least some of said conductive vias disposed to couple at least portions of at least some of the first and second set of strip conductors to a ground plane of the stripline.

15. The symmetric stripline Marchand balun of claim 11 further comprising:

an open circuit isolator stub; and a resistive load wherein the open circuit isolator stub is coupled through the resistive load to a port of the symmetric stripline Marchand balun.

16. A balun comprising:

a first substrate having first and second opposing surfaces;

a coupled-line set including a first set of conductors disposed on one of the first and second substrate surfaces and a second set of conductors disposed on one of the first and second substrate surfaces such that the coupled-line set forms a Marchand balun; and a plurality of common mode isolator circuits provided from a set of conductors wherein at least some of said conductors which form said common mode isolator also form at least a portion of the Marchand balun.

17. The balun of claim 16 wherein at least one of said common mode isolator circuits comprises a common mode isolator integrated at a differential port of the balun.

18. The balun of claim 15 further comprising a plurality of isolators coupled in cascade.

19. The balun of claim 16 wherein said common mode isolator circuit comprises broadside coupled lines located proximate the differential matching section of the Marchand balun.

20. The balun of claim 16 wherein said common mode isolator circuit comprises microstrip transmission lines.

* * * * *